US006302805B1

(12) United States Patent
Penley

(10) Patent No.: US 6,302,805 B1
(45) Date of Patent: Oct. 16, 2001

(54) GOLF CLUB SHAFT WITH IMPROVED PERFORMANCE CHARACTERISTICS

(75) Inventor: Carter L. Penley, San Diego, CA (US)

(73) Assignee: Penley Sports, LLC, San Diego, CA (US)

( * ) Notice: Subject to any disclaimer, the term of this patent is extended or adjusted under 35 U.S.C. 154(b) by 0 days.

(21) Appl. No.: 09/444,760

(22) Filed: Nov. 22, 1999

(51) Int. Cl.[7] ..... A63B 53/10
(52) U.S. Cl. ..... 473/318; 473/319
(58) Field of Search ..... 473/316–323

(56) References Cited

U.S. PATENT DOCUMENTS

| | | | | |
|---|---|---|---|---|
| D. 245,441 | * | 8/1977 | Middlestate . | |
| 1,974,271 | * | 9/1934 | Hackett . | |
| 2,460,445 | | 2/1949 | Bigler . | |
| 2,652,256 | | 9/1953 | Thomas . | |
| 3,921,984 | | 11/1975 | Winter . | |
| 3,961,796 | | 6/1976 | Thompson . | |
| 4,423,874 | | 1/1984 | Stuff, Jr. . | |
| 4,555,112 | | 11/1985 | Masghati . | |
| 4,563,007 | * | 1/1986 | Bayliss et al. . | |
| 5,093,162 | | 3/1992 | Fenton et al. . | |
| 5,121,922 | | 6/1992 | Harsh, Sr. . | |
| 5,496,028 | * | 3/1996 | Chien . | |
| 5,538,769 | * | 7/1996 | Sandman | 473/319 |
| 5,599,242 | | 2/1997 | Solviche et al. . | |
| 5,626,529 | | 5/1997 | Roy . | |
| 5,735,752 | * | 4/1998 | Antonious | 473/317 |
| 5,776,008 | * | 7/1998 | Lundberg | 473/320 |
| 5,865,688 | * | 2/1999 | Bae | 473/323 |
| 5,943,758 | | 8/1999 | Haas . | |
| 5,964,670 | * | 10/1999 | Cheng | 473/319 |

FOREIGN PATENT DOCUMENTS

| | | | |
|---|---|---|---|
| 256049 | * | 8/1926 | (GB) . |
| WO 98/23338 | * | 6/1998 | (GB) . |

* cited by examiner

*Primary Examiner*—Jeanette Chapman
*Assistant Examiner*—Stephen L. Blau
(74) *Attorney, Agent, or Firm*—Nydegger & Associates

(57) ABSTRACT

A club shaft for a golf club and method for making a club shaft for a golf club are provided herein. The club shaft includes a shaft butt section, a shaft tip section and a shaft intermediate section which connects the shaft butt section to the shaft tip section. The shaft intermediate section includes a shaft outer diameter which tapers from the shaft butt section to the shaft tip section. Uniquely, the amount of taper varies along the shaft intermediate section to avoid any abrupt transitions in the club shaft. The resulting club shaft has a continuous, smooth geometry, without stress concentration areas. This improves the strength, fatigue and fracture toughness of the club shaft. Further, the amount of taper can be specifically tailored to obtain a club shaft having the desired moment of inertia, resistance to torsion, mass distribution, flexure, frequency, strength, and stiffness properties.

14 Claims, 8 Drawing Sheets

(33)

GOLF CLUB SHAFT WITH IMPROVED PERFORMANCE CHARACTERISTICS

FIELD OF THE INVENTION

The present invention is directed to club shafts for golf clubs. More specifically, the present invention is directed to a golf club shaft having improved strength, stiffness, durability and torque characteristics.

BACKGROUND

The game of golf is becoming increasingly popular in the United States and internationally. Presently, golfers, both professional and non-professional, are continuously striving to improve their golf game. It is well known that the physical characteristics of the club shaft of a golf club can effect the travel of the golf ball. Club shafts having a high stiffness to weight ratio, low shaft vibration, good strength, good resistance to torsion and good resilience to fatigue are usually preferred by golfers.

Typically, each golf club shaft includes a shaft tip section, a shaft intermediate section and a shaft butt section. The shaft tip section typically has a relatively small outer diameter when compared to the shaft butt section. A head is secured to the shaft tip section, while a grip is secured to the shaft butt section. The shaft intermediate section extends between and tapers from the shaft butt section to the shaft tip section. Usually, the taper is substantially linear or includes a series of sequentially smaller, annular steps.

Unfortunately, existing club shafts are not entirely satisfactory. For example, existing club shafts can be too weak, have poor resistance to torsion and poor resilience to fatigue. One way to improve the strength and resistance to torsion of the club shaft is to increase the wall thickness of the club shaft. However, the resulting thicker walled club shaft is often too heavy and/or has other undesirable performance characteristics.

In light of the above, it is an object of the present invention to provide a club shaft and method for manufacturing a club shaft having improved strength and resistance to fatigue crack propagation. Yet another object of the present invention is to provide a composite club shaft having improved durability, torque characteristics and performance characteristics.

SUMMARY

The present invention is directed to a club shaft for a golf club which satisfies these needs. The club shaft includes a shaft butt section, a shaft tip section, and a shaft intermediate section which connects the shaft butt section to the shaft tip section. The shaft intermediate section has an outer diameter which tapers from the shaft butt section to the shaft tip section.

Uniquely, the rate or amount of taper in the outer diameter of the shaft intermediate section varies along the shaft intermediate section. Stated another way, the slope of the taper varies along the shaft intermediate section. Preferably, the outer diameter of the shaft intermediate section has a slope of approximately zero degrees relative to a shaft longitudinal axis near the shaft butt section and the shaft tip section. This allows the club shaft to have a continuous, smooth geometry and eliminates the abrupt transitions between shaft butt section, the shaft intermediate section, and the shaft tip section. The resulting club shaft has improved strength, durability and torque characteristics, without increasing the wall thickness or fiber modulus of the club shaft.

Each club shaft provided herein can be made by wrapping one or more patterns around a form, i.e. a mandrel or a bladder. Alternately, each club shaft could be made by winding one or more filaments around the form, or molding each club shaft in a closed die.

The invention is also a method for manufacturing a club shaft. The method includes the steps of: (i) providing a form; (ii) providing at least one pattern; and (iii) wrapping the at least one pattern around the form. Each of the forms can be a mandrel having an elongated cylindrical rod-like structure. Each form includes a form butt section, a form tip section, and a form intermediate section. In order to make the club shaft outlined above, the form intermediate section includes an outer diameter which tapers from the form butt section to the form tip section. Importantly, the rate or amount of taper of the outer diameter varies along the form intermediate section.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
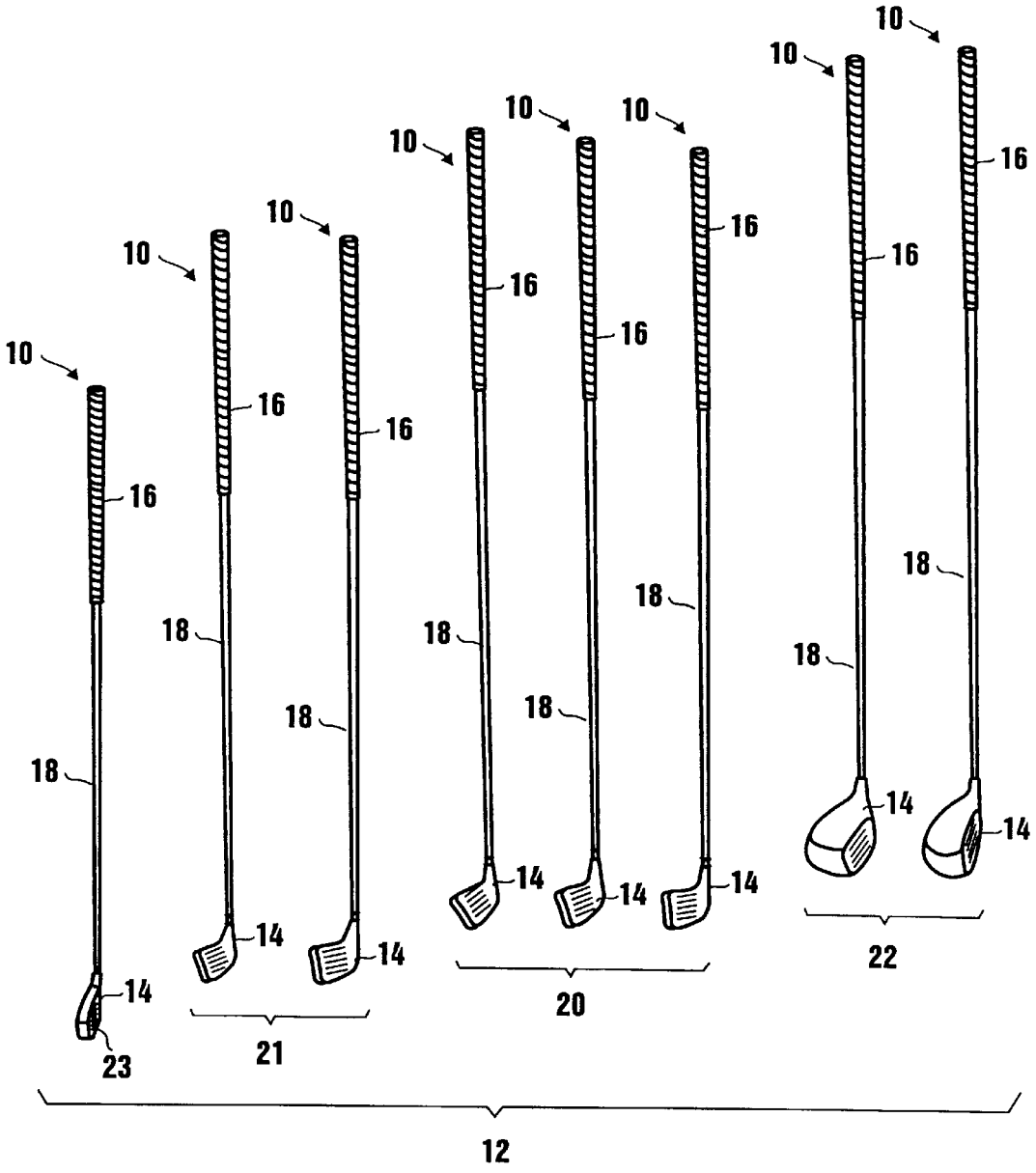
FIG. 1 is a side plan view of a representative set of golf clubs having features of the present invention.

FIG. 1 illustrates a plurality of golf clubs 10 in a set 12 of golf clubs 10. Each golf club 10 includes a head 14, a grip 16 and a club shaft 18. Importantly, the club shaft 18 for each golf club is uniquely manufactured and designed to have improved strength characteristics, smoother load distribution, torque characteristics and durability. This allows a golf player (not shown) to have better control over flight, trajectory, distance and shot dispersion.

A typical set 12 of golf clubs 10 includes a set of irons 20, a set of woods 22, one or more wedges 21, and one or more putters 23. The actual number of golf clubs 10 in a set 12 of golf clubs can vary. For example, typically, a player in a tournament utilizes a set 12 of golf clubs 10 which includes No. 1 through No. 9 irons 10 and a No. 1, No. 3, and No. 5 woods 22. The irons 20, wedges 21, woods 22, and putter 23 shown in FIG. 1 are for exemplary purposes.

Figure 2:
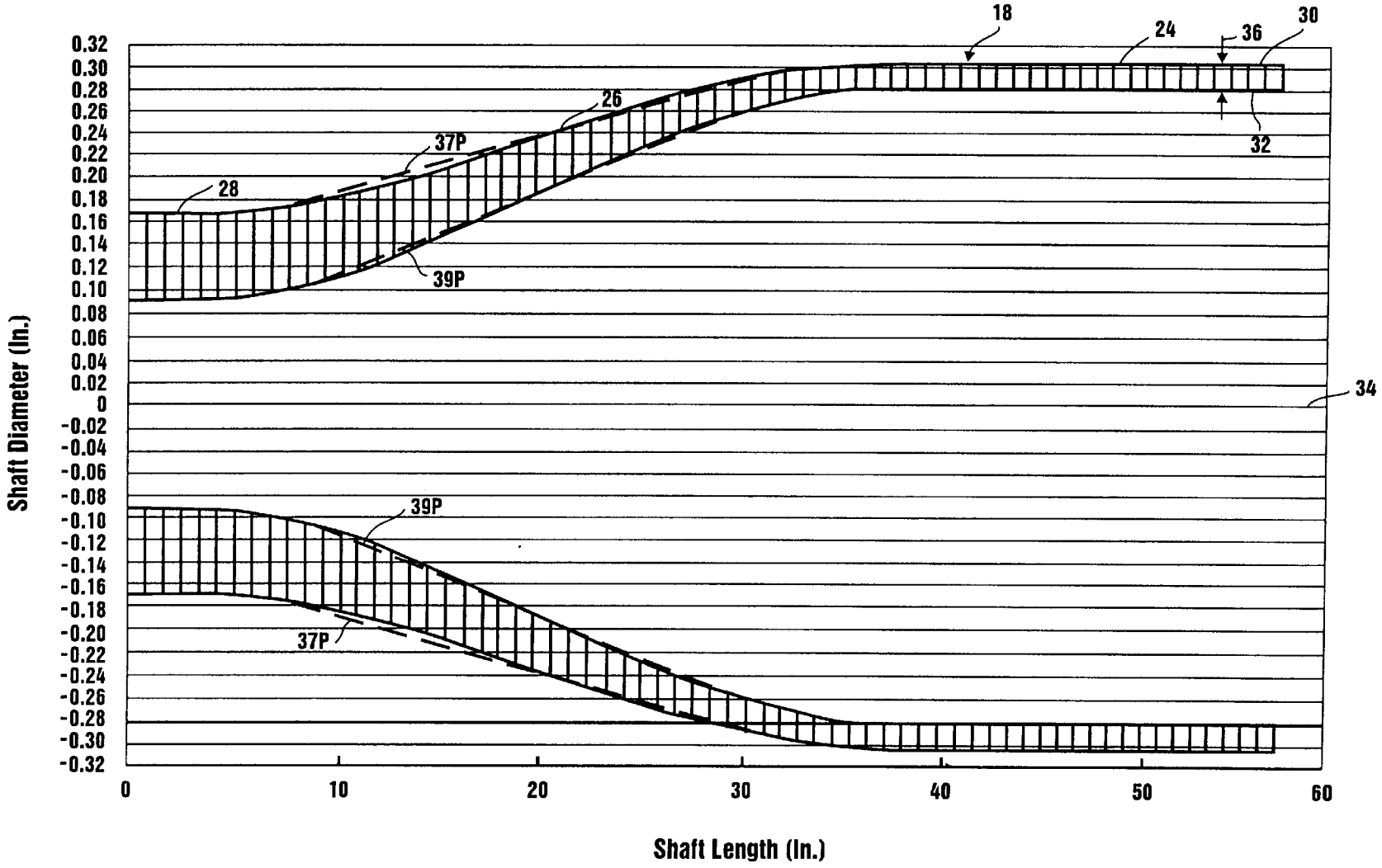
FIG. 2 is a graph which illustrates the dimensions of a first embodiment of a club shaft having features of the present invention.
Figure 3:
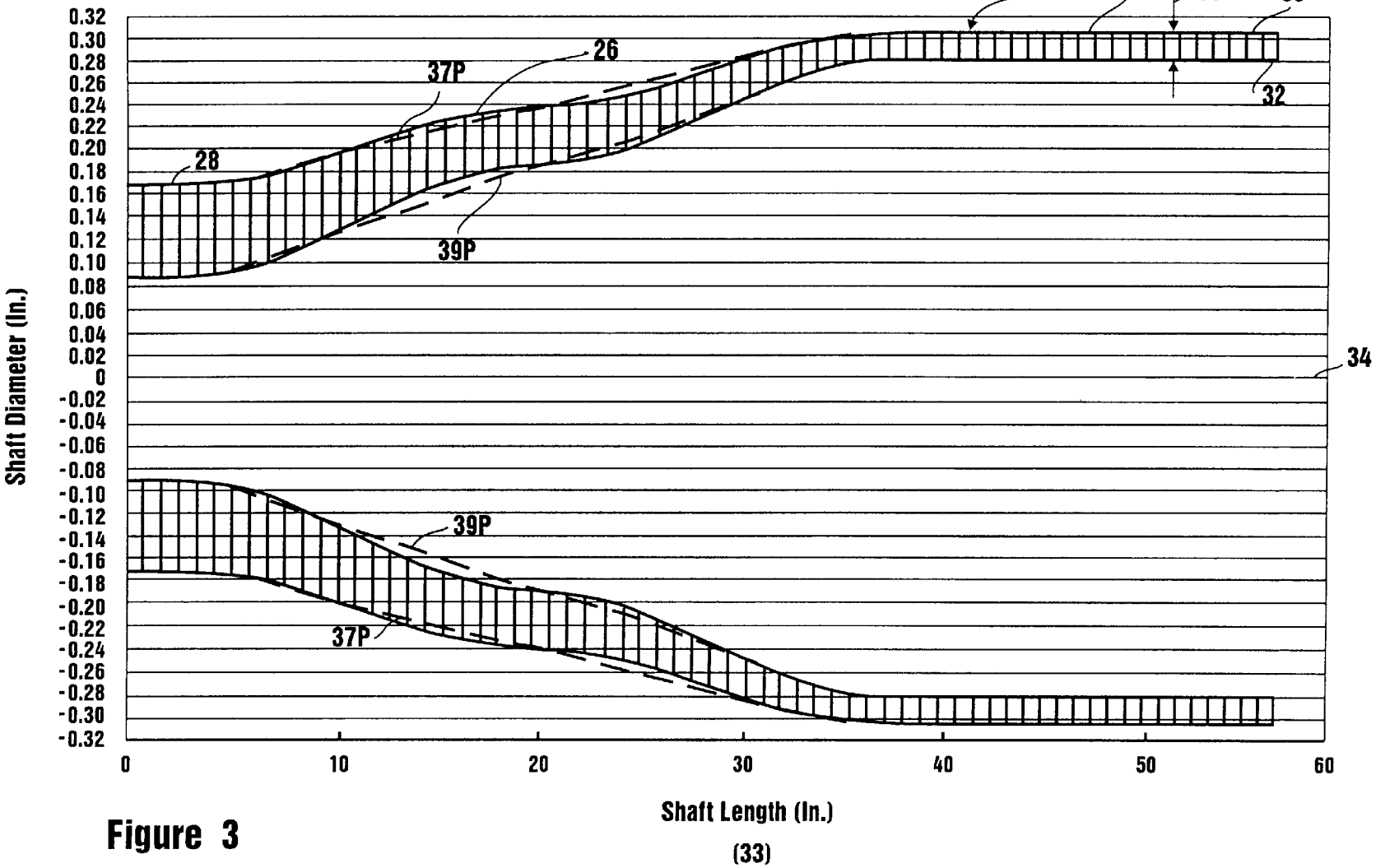
FIG. 3 is a graph which illustrates the dimensions of another embodiment of a club shaft having features of the present invention.
Figure 4:
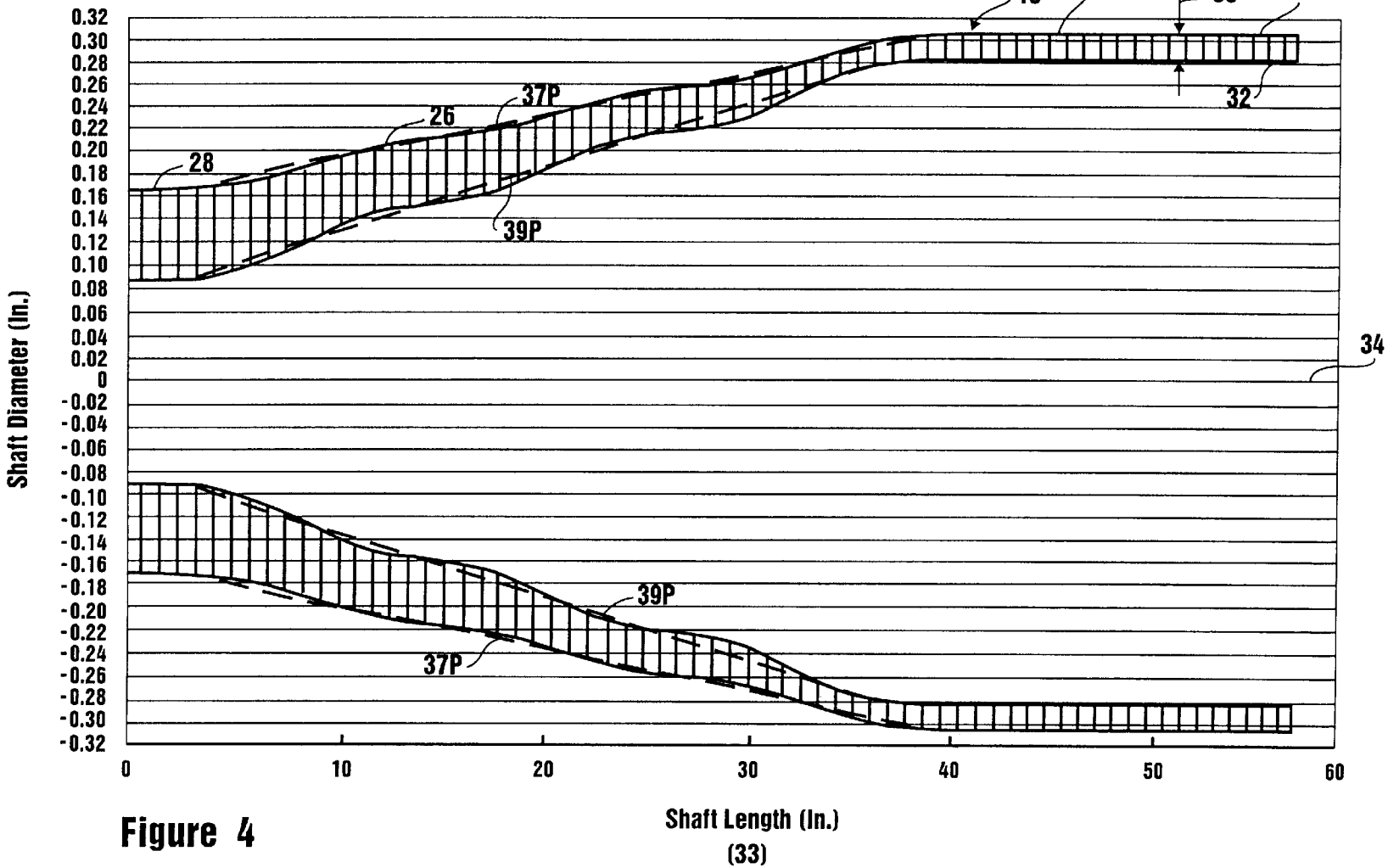
FIG. 4 is a graph which illustrates the dimensions of yet another embodiment of a club shaft having features of the present invention.

FIGS. 2–4 each illustrate an alternate, cross-sectional view of a club shaft 18 positioned on a graph. It should be recognized that these embodiments provided below are merely exemplary and can be varied. Each club shaft 18 is substantially tubular and includes a shaft butt section 24, a shaft intermediate section 26, and a shaft tip section 28. The grip 16 (illustrated in FIG. 1) encircles and attaches to the shaft butt section 24 while the head 14 (illustrated in FIG. 1) attaches to the shaft tip section 28. The club shaft 18 has a shaft outer diameter 30, a shaft inner diameter 32, a shaft length 33 and a shaft longitudinal axis 34.

Depending upon the design of the grip 16 and the head 14, the shaft butt section 24 and the shaft tip section 28 can have a substantially constant outer diameter as illustrated in FIGS. 2–4 or a tapering diameter (not shown). The club shafts 18 illustrated herein have a shaft wall thickness 36 which varies along the shaft length 33 of the club shaft 18.

The shaft intermediate section 26 connects the shaft butt section 24 to the shaft tip section 28. Importantly, the present invention recognizes that the physical characteristics of each club shaft 18 can be tailored by adjusting the shape of the shaft intermediate section 26. The club shafts 18 provided herein are superior to prior art club shafts because of the unique shape of the shaft intermediate section 26. To highlight the unique shape, dashed lines designated 37P in FIGS. 2–4 illustrates how the shaft outer diameter 30 would appear if the shaft intermediate section 26 had a substantially linear taper. Similarly, dashed lines 39P illustrate how the shaft inner diameter 32 would appear if the shaft intermediate section 26 had a substantially linear taper.

It should be noted from FIGS. 2–4 that the shaft outer diameter 30 and the shaft inner diameter 32 of the shaft intermediate section 26 tapers from the shaft butt section 24 to the shaft tip section 28. Importantly, the rate or amount of taper of the shaft outer diameter 30 varies along the entire shaft intermediate section 26. Thus, the slope or pitch of the taper relative to the shaft longitudinal axis 34 varies along the shaft intermediate section 26. Further, the slope of the taper of the shaft intermediate section 26 relative to the shaft tip section 28 or the shaft butt section 24, near the shaft tip section 28 and the shaft butt section 24 is approximately zero. This allows the club shaft 18 to have a smooth, continuous shape and eliminates the abrupt transition from (i) the shaft butt section 24 to the shaft intermediate section 26 and (ii) the shaft intermediate section 26 to the shaft tip section 28. Thus, the transition between the shaft butt section 24 and the shaft intermediate section 26 and the transition between the shaft intermediate section 26 and the shaft tip section 28 is gradual and rounded.

Stated another way, the shaft outer diameter 30 and the shaft inner diameter 32 of the shaft intermediate section 26 includes a superficially segmented, undulating or curved surface profile. FIGS. 2–4 illustrate three preferred embodiments of the club shaft 18. In the embodiment illustrated in FIG. 2, the cross-sectional profile of the shaft outer diameter 30 relative to dashed lines 37P is substantially similar to a single, rounded, sine shaped wave. Similarly, in FIG. 2, the cross-sectional profile of the shaft inner diameter 32 relative to dashed lines 39P is also substantially similar to a ingle, rounded sine wave. Alternately, in the embodiment illustrated in FIG. 3, the cross-sectional profile of the shaft outer diameter 30 relative to dashed lines 37P is substantially similar to a pair of sine shaped waves. Similarly, in FIG. 3, the cross-sectional profile of the shaft inner diameter 32 relative to dashed lines 39P is also substantially similar to a pair of sine shaped waves. Alternately, in the embodiment illustrated in FIG. 4, the cross-sectional profile of the shaft outer diameter 30 relative to dashed lines 37P is substantially similar to three sine shaped waves. Somewhat similarly, in FIG. 4, the cross-sectional profile of the shaft inner diameter 32 relative to the dashed line 39P is also substantially similar to three sine shaped waves.

In the embodiments provided herein, the shaft tip section 28 extends from approximately 0 to 4 inches, the shaft intermediate section 26 extends from approximately 4 to 38 inches, while the shaft butt section 24 extends from approximately 38 to 58 inches.

Figure 5:
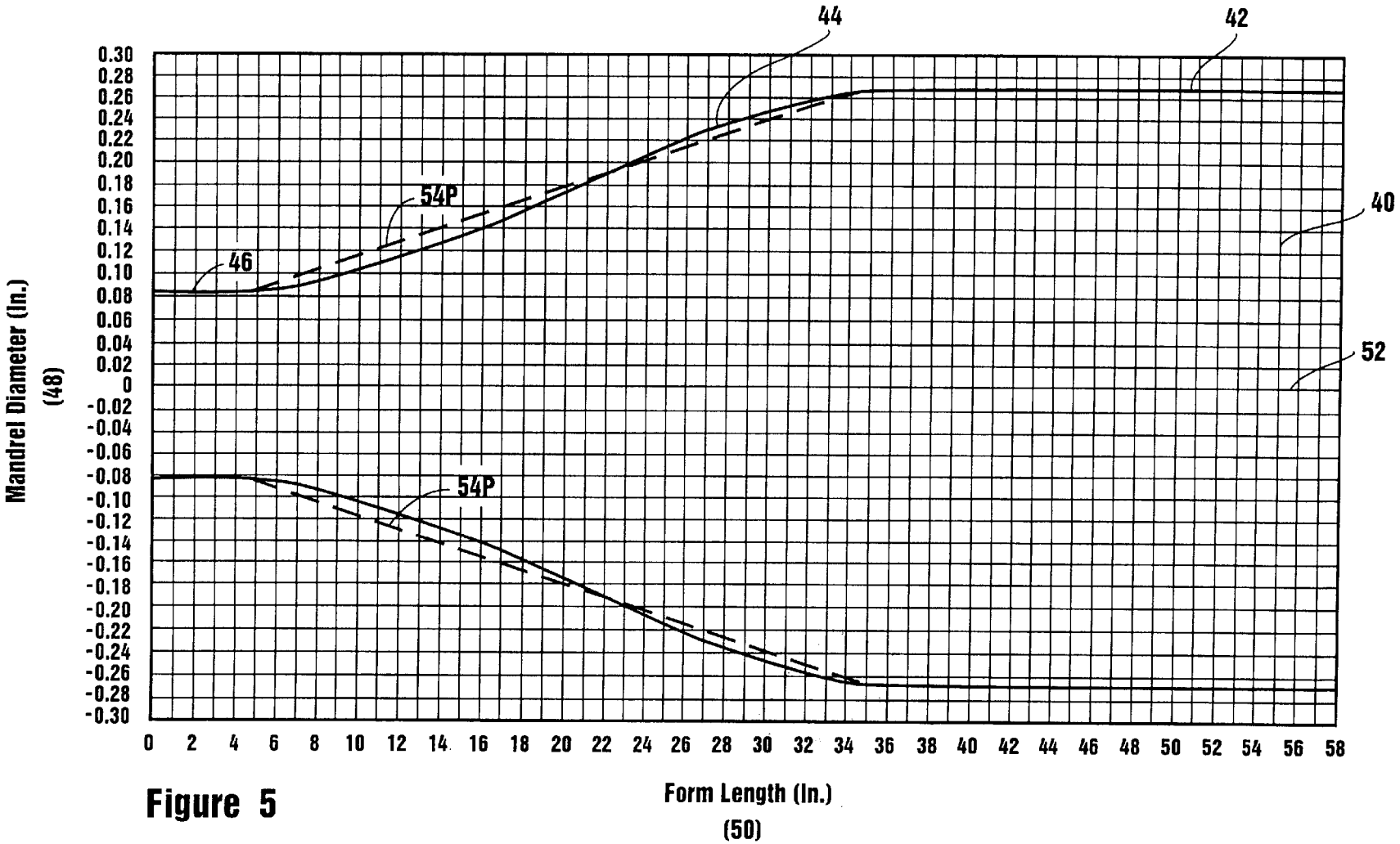
FIG. 5 is a graph which illustrates the dimensions of a form having features of the present invention.
Figure 6:
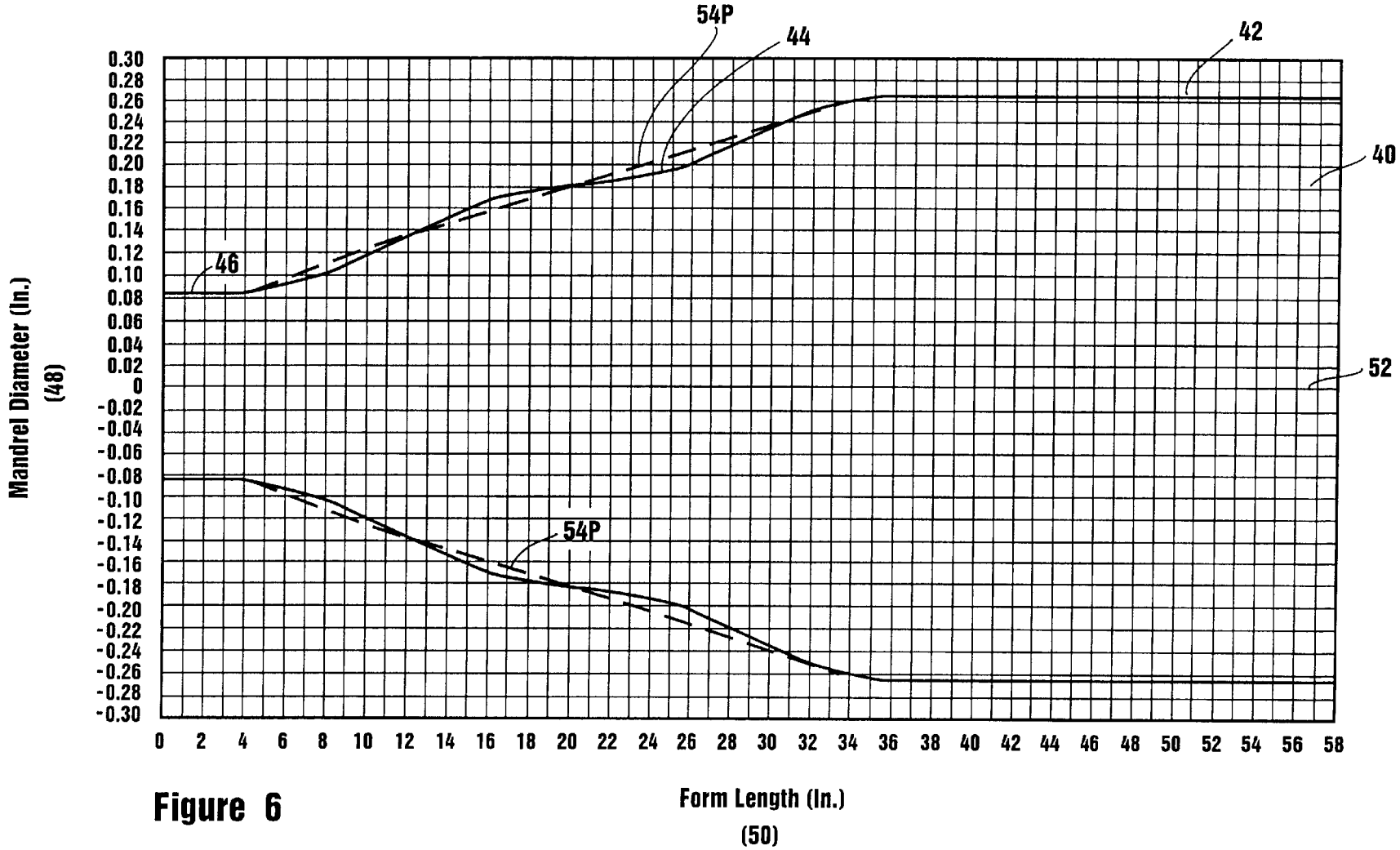
FIG. 6 is a graph which illustrates the dimensions of another embodiment of a form.
Figure 7:
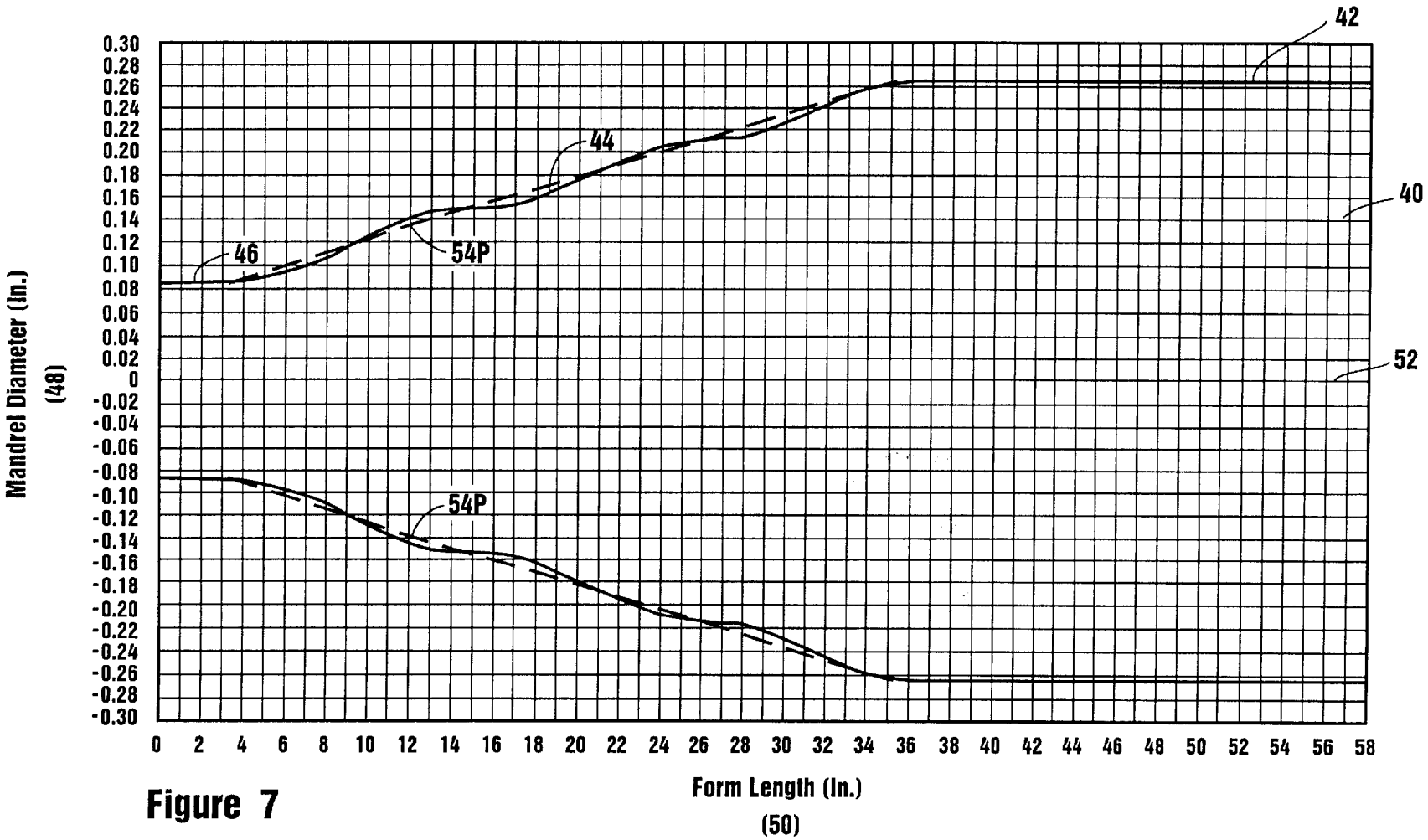
FIG. 7 is a graph which illustrates the dimensions of yet another embodiment of a form.

As provided herein, the club shafts 18 can be made by sequentially wrapping a plurality of patterns 38 (shown in FIG. 8) onto a form 40 (shown in FIGS. 5–7). FIGS. 5–7 each illustrate an alternate, cross-sectional view of a form 40 positioned on a graph. Each form 40 illustrated in FIGS. 5–7 is a mandrel which is substantially solid, rod shaped and has a circular cross-section. The form 40 includes a form butt section 42, a form intermediate section 44, and a form tip section 46. The form intermediate section 44 attaches the form butt section 42 and the form tip section 46. The form 40 has a form outer diameter 48, a form length 50 and a form longitudinal axis 52.

A cross-sectional profile of each of the three forms 40 is provided in FIGS. 5–7 respectively. Importantly, the form 40 illustrated in FIG. 5 can be used to make the club shaft 18 illustrated in FIG. 2. Similarly, the form 40 illustrated in FIG. 6 can be used to make the club shaft 18 illustrated in FIG. 3. Further, the form 40 illustrated in FIG. 7 can be used to make the club shaft 18 illustrated in FIG. 4.

The form outer diameter 48 is substantially equal to the shaft inner diameter 32 of the club shaft 18. To manufacture the unique club shafts 18 provided above, the form intermediate section 44 of each form 40 has a unique shape. To highlight the unique shape, dashed lines 54P in FIGS. 5–7 illustrate how the form outer diameter 48 would appear if the form intermediate section 44 had a substantial linear taper.

It should be noted from FIGS. 5–7, that the form outer diameter 48 of the form intermediate section 44 tapers from the form butt section 42 to the form tip section 46. Importantly, the rate or amount of taper varies along the entire form intermediate section 44. Thus, the slope or pitch of the taper relative to the form longitudinal axis 52 varies along the form intermediate section 44. Further, the slope of the taper of the form intermediate section 44 relative to the form longitudinal axis 52 near the form tip section 46 and the form butt section 42 is approximately zero. This feature facilitates the manufacturing of a club shaft 18 having a smooth, continuous shape and eliminates any abrupt transitions in the club shaft 18.

Stated another way, the form outer diameter 48 includes a superficially segmented, undulating or curved surface profile. FIGS. 5–7 illustrate three preferred embodiments of the form 40. In the embodiment illustrated in FIG. 5, the cross-sectional profile of the form outer diameter 48 relative to dashed lines 54P is substantially similar to a single, rounded sine wave. Alternately, in the embodiment illustrated in FIG. 6, the cross-sectional profile of the form outer diameter 48, relative to dashed lines 54P is substantially similar to a pair of sine waves. Still alternately, in the embodiment illustrated in FIG. 7, the cross-sectional profile of the form outer diameter 48 relative to dashed lines 54P is substantially similar to three sine waves.

It is important to recognize that the embodiments provided in FIGS. 5–7 are for exemplary purposes only and can be varied to alter the performance characteristics of the club shaft 18.

Figure 8:
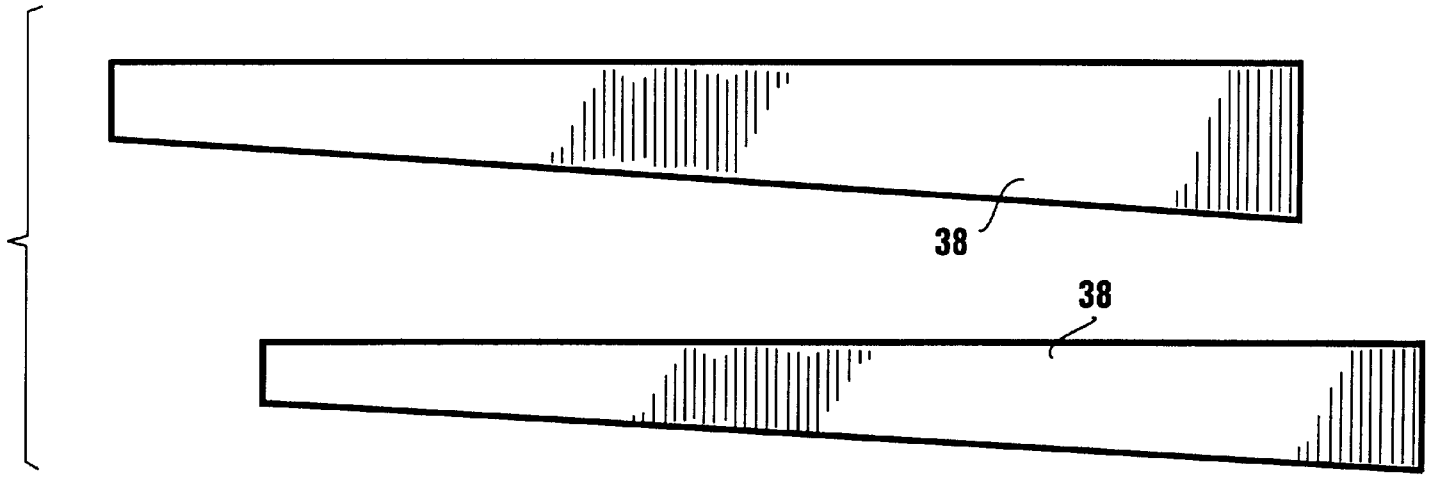
FIG. 8 is a side plan view of a plurality of patterns having features of the present invention.

The patterns 38 are sequentially wrapped around the form 40 to form the club shaft 18. The number, size, shape and thickness of the patterns 38 can vary. Typically, each pattern 38 is a thin sheet of material having a thickness of between approximately 0.003 inches to 0.008 inches. Each pattern 38 is preferably impregnated with a resin to hold the patterns 38 together after heat cure to form the club shaft 18. Each pattern 38, for example, can be made of S-Glass, 34-700 high tensile, high strength, graphite, high modulus graphite and/or aramid fiber. The material for the patterns 38 can be purchased from Newport Adhesives and Composites, located in Irvine, Calif. The patterns 38 illustrated in FIG. 8 are merely representative of suitable patterns 38. For example, the patterns 38 can also include ±angle plys (not shown), strength plys (not shown), and/or one or more tip inserts or outserts (not shown).

The manufacturing processes provided herein allows the manufacturer to specifically, uniquely tailor the characteristics of the club shafts 18 by adjusting the shape of the form intermediate section 44. This allows the manufacturer to finely tune the performance and strength characteristics of the club shafts 18.

Figure 9:
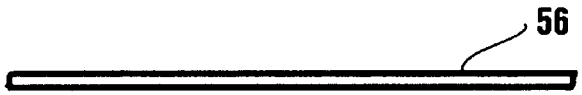
FIG. 9 is a side plan view of a portion of a filament.
Figure 10:
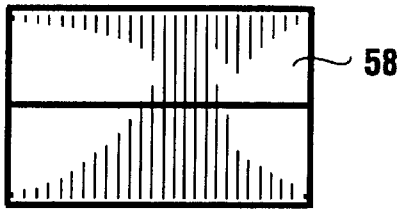
FIG. 10 is a side plan view of a die which can be used to make a club shaft having features of the present invention.

Importantly, other manufacturing processes can be used to manufacture a club shaft 18 in accordance with the present invention. In particular the form 40 could be a fluid filled bladder (not shown) instead of a mandrel 41. Alternately, one or more filaments 56 (illustrated in FIG. 9) could be wrapped around the form 40 instead of the patterns 38. Still alternately, each club shaft 18 could be molded from a metal or other material in a closed die 58 (illustrated in FIG. 10).

While the particular club shafts 18, as herein shown and disclosed in detail, are fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A club shaft for a golf club, the golf club including a grip and a head, the club shaft comprising:

a shaft butt section adapted to receive the grip;

a shaft tip section adapted to receive the head; and a shaft intermediate section which connects the shaft butt section to the shaft tip section, the shaft intermediate section having a taper of diminishing cross section from the shaft butt section to the shaft tip section, and being formed with an inner surface and an outer surface, the inner surface defining an inner surface profile extending from the shaft tip section to the shaft butt section, wherein the inner surface profile is substantially conforming to a sine wave cycle, and the outer surface defining an outer surface profile extending from the shaft tip section to the shaft butt section, wherein the outer surface profile is substantially conforming to a sine wave cycle.

2. The club shaft of claim 1 wherein the amount of taper varies along substantially the entire shaft intermediate section.

3. The club shaft of claim 1 wherein the shaft intermediate section is tubular.

4. The club shaft of claim 1 wherein the shaft intermediate section is made by wrapping at least one pattern around a mandrel.

5. The club shaft of claim 1 wherein the shaft intermediate section includes a shaft outer diameter having a slope of approximately zero degrees near the shaft butt section.

6. The club shaft of claim 1 wherein the shaft intermediate section includes a shaft outer diameter having a slope of approximately zero degrees near the shaft tip section.

7. The club shaft of claim 1 wherein the shaft intermediate section includes a shaft outer diameter having an undulating surface profile.

8. The club shaft of claim 1 wherein the shaft intermediate section includes a shaft outer diameter having a slope of approximately zero degrees near the shaft butt section and the shaft tip section.

9. The club shaft of claim 1 wherein the slope of the taper relative to a shaft longitudinal axis varies along the shaft intermediate section.

10. The club shaft of claim 1 made by the process of wrapping at least one pattern around a form.

11. The club shaft of claim 1 made by the process of wrapping a filament around a form.

12. The club shaft of claim 1 made in a die.

13. The club shaft of claim 1 wherein the inner surface profile has two portions, each portion being substantially conforming to a sine wave cycle, and wherein the outer surface profile has two portions, each portion being substantially conforming to a sine wave cycle.

14. The club shaft of claim 1 wherein the inner surface profile has three portions, each portion being substantially conforming to a sine wave cycle, and wherein the outer surface profile has three portions, each portion being substantially conforming to a sine wave cycle.

* * * * *